United States Patent [19]

Mecklenburg et al.

[11] 4,197,439

[45] Apr. 8, 1980

[54] TOUCH-RESPONSIVE INDICATOR SWITCH

[75] Inventors: Alfred C. Mecklenburg, Arlington; Arthur P. Venditti, Peabody, both of Mass.

[73] Assignee: Parker Brothers, Beverly, Mass.

[21] Appl. No.: 11,713

[22] Filed: Feb. 12, 1979

[51] Int. Cl.[2] ..... H01H 3/12; H01H 9/26; H01H 9/00

[52] U.S. Cl. ..... 200/159 B; 200/5 A; 200/292; 200/314

[58] Field of Search ..... 200/159 B, 292, 310, 200/311, 313, 314, 5 A

[56] References Cited

U.S. PATENT DOCUMENTS

| | | | |
|---|---|---|---|
| 3,643,041 | 2/1972 | Jackson | 200/5 A |
| 4,088,855 | 5/1978 | Emery | 200/314 X |
| 4,109,118 | 8/1978 | Kley | 200/314 X |

OTHER PUBLICATIONS

Promis et al., IBM Technical Disclosure Bulletin, vol. 19, No. 2, Jul. 1979, #405, Control Panel.

Geil et al., IBM Technical Disclosure Bulletin, vol. 13, No. 7, Dec. 1970, #1943, Elastic Dia. Switch.

*Primary Examiner*—Steven M. Pollard

*Attorney, Agent, or Firm*—Kenway & Jenney

[57] ABSTRACT

In the touch-responsive indicator switch construction disclosed herein, an electrically energizable light source is viewable through a printed circuit contact assembly. In the contact assembly, an essentially transparent flexible polymer sheet is folded to provide three juxtaposed layers, a ring-shaped contact element on the top layer being deflectable through an aperture on the intermediate layer to make contact with a similar ring-shaped contact element on the bottom layer, the light source being viewable through the centers of the ring-shaped contact elements.

8 Claims, 3 Drawing Figures

TOUCH-RESPONSIVE INDICATOR SWITCH

BACKGROUND OF THE INVENTION

The present invention relates to touch-responsive indicator switch apparatus and more particularly to such a switch apparatus in which a light source is viewable through an essentially transparent, touch-responsive contact assembly.

There have previously been known various types of indicator switches, e.g. mechanical switch assemblies incorporating indicator lamps and the like. Typically, however, these switch devices have been relatively complicated electromechanical assemblies including both the parts normally associated with a switch and those associated with a lamp and socket. The use of such complicated assemblies has heretofore typically been limited to industrial applications. A need has been perceived for a simpler and lower cost indicator switch apparatus which can be incorporated into various consumer items such as toys, games and teaching devices, as well as into business devices such as point-of-sale data entry terminals and the like.

Among the several objects of the present invention may be noted the provision of a touch-responsive indicator switch apparatus which is of singularly simple construction and which is yet entirely effective in operation; the provision of such apparatus which is highly reliable and yet inexpensive. Other objects and features will be in part apparent and in part pointed out hereinafter.

SUMMARY OF THE INVENTION

Briefly, a touch-responsive indicator switch according to the present invention involves an electrically energizable light source and, over that light source, a contact assembly including three juxtaposed layers of an essentially transparent flexible polymer material. On the inward side of the outermost of the layers is a second ring-shaped printed circuit contact element. The middle layer is apertured to permit electrical contact between the first and second contact elements when the outer layer is touched and deflected through this aperture. Interconnected with the light source and the contact elements is a circuit means having a plurality of states, these states including at least a first state in which the source is energized and a second state in which the second source is de-energized. The circuit means is responsive to closures between the contact elements for changing states. Accordingly, the state of the circuit means can be altered by touching the outermost layer and an indication responsive to the state of the circuit means can be observed through the center portions of the ring-shaped contact elements.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
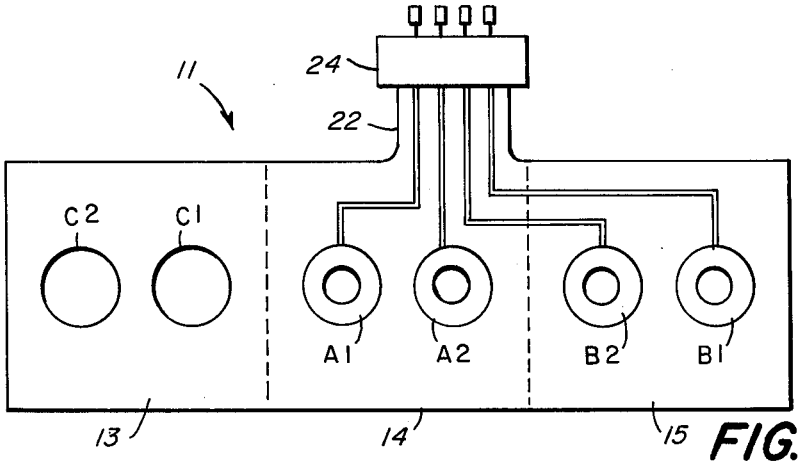
FIG. 1 is a plan view of a printed circuit contact means employed in the switch apparatus of the present invention, the printed circuit being unfolded from its operational folded configuration.
Figure 2:
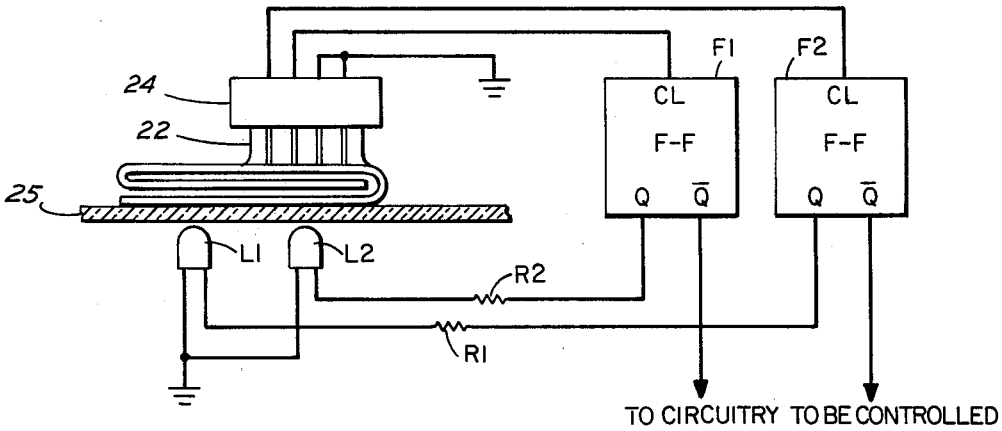
FIG. 2 is a partially schematic diagram of indicator switch apparatus constructed in accordance with the present invention, showing the printed contact assembly of FIG. 1 in its normal folded arrangement and interconnected with light sources and control circuitry.

Referring now to FIG. 1, the contact assembly illustrated there comprises a sheet of a flexible, essentially transparent polymer material, the sheet being indicated generally by reference character 11. Sheet 11 is formed to provide three portions 13, 14, and 15 of similar dimensions so that the sheet can be folded, along lines indicated at 17 and 18, to provide three juxtaposed portions or layers as may be seen in FIG. 2. In FIG. 2, the folded contact assembly is shown as being positioned over two solid state light sources, i.e. light emitting diodes L1 and L2. As may be seen from FIG. 2, the center portion 14 of sheet 11 forms the top or outermost layer of the contact assembly while the portion 15 forms the bottom or innermost layer with the portion 13 constituting an intermediate or spacing layer.

Sheet 11 carries printed circuit conductors forming contact elements and circuit paths as described in greater detail hereinafter. With reference to FIG. 1, it should be understood that the conductors are on the bottom of the transparent sheet 11 as viewed in that Figure. On the underside of the central portion of the sheet 11, i.e. the portion which is on top when the assembly is folded, are formed two ring-shaped contact elements A1 and A2. These contact elements are arranged so as to be aligned with the light sources L1 and L2 in the final assembly. Two similar contact elements B1 and B2 are formed on the portion 15. As will be understood from the preceding description, these contact elements will be on the upper side or portion 15 when the sheet 11 is folded. The contact elements B1 and B2 positioned on the sheet portion 15 so as to be aligned with the contact elements A1 and A2 when sheet portion 15 is folded under portions 14 and 13 in the manner shown in FIG. 2. Portion 13 of sheet 11 is apertured as indicated by reference characters C1 and C2, these apertures being located so that each is aligned with and between a respective facing pair of the contact elements, i.e., the aperture C1 is between the contact elements A1 and B1 and the aperture C2 is between the contact elements A2 and B2. While the contact elements A1, A2, B1 and B2 are described herein as "ring-shaped," the use of this term should not be understood as requiring that the elements be circular. Rather, what is meant is a conductor forming a periphery around a central or core region.

Printed circuit conductors extend from each of the contact elements to a tab 22 extending from portion 14. Tab 22 is adapted to be engaged by a connector 24 for establishing electrical connections to the printed circuitry.

Preferably, a relatively rigid and essentially transparent backing member is interposed between the light sources L1 and L2 and the folded sheet 11 which constitutes the contact assembly. In FIG. 2, such a backing member is indicated by reference character 25 and may, for example, comprise a sheet of a plastic which is transparent to the light given off by the light emitting diodes L1 and L2. A plastic having a ruby tint is appropriate when the light emitting diode L1 and L2 are of the conventional type giving off red light.

Since both the backing plate 25 and the flexible sheet 11 are essentially transparent to the light given off by the light emitting diodes L1 and L2 the state of energization of either of these light sources can be viewed right through the contact assembly, i.e. through the open centers of the contact elements A1 and B1 even though these contact elements may themselves be essentially opaque.

Figure 3:
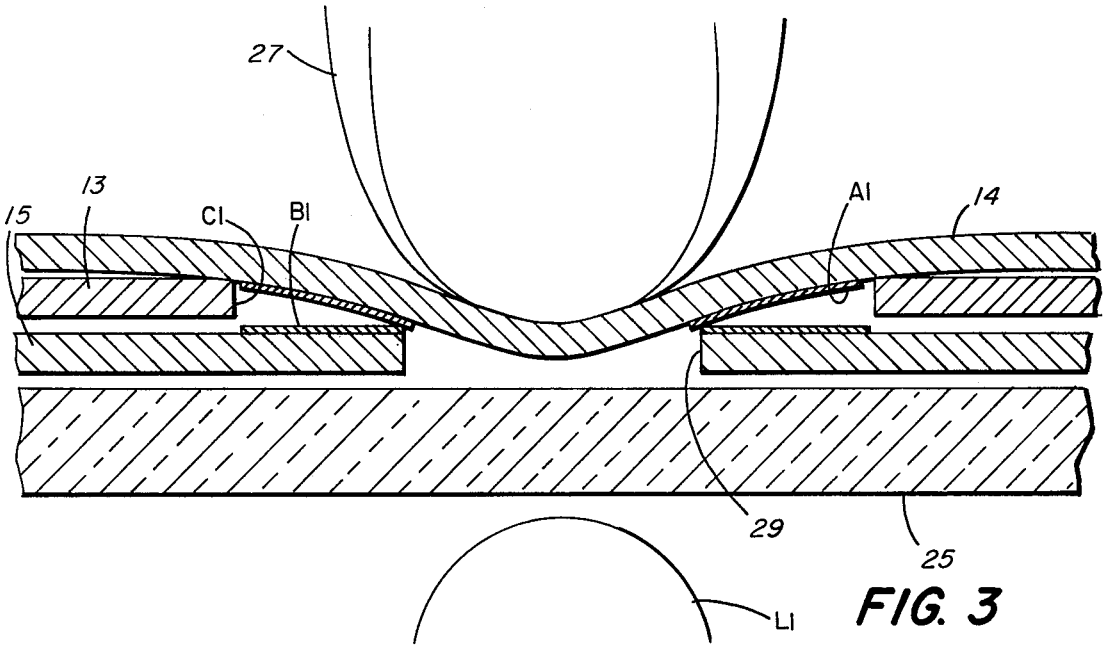
FIG. 3 is a sectional view, to enlarged scale, of the contact assembly of FIGS. 1 and 2, showing the manner in which contact closures are obtained.

FIG. 3 illustrates, to enlarged scale, the detailed operation of the contact assembly. When the outer layer 14 is touched in the vicinity of contact element A1 by an operator's finger, indicated by reference character 27, the flexible polymer material is deflected, through the aperture C1 in the intermediate layer 13, so that the contact element A1 makes electrical connection with the aligned contact B1 on the bottommost layer 15, this layer being supported by the backing means 25. To facilitate the making of this contact, it is preferred that the bottommost portion 15 of the sheet 11 be apertured in the core of the ring-shaped contact element B1 as indicated by reference character 29.

For implementing a push-on, push-off mode of operation, the contact assembly and the light sources L1 and L2 are interconnected with a pair of flip flop circuits F1 and F2. These may, for example, comprise conventional J-K type flip flop circuits. The contact elements B1 and B2 are both grounded, while the contact elements A1 and A2 are connected to respective clock inputs of the flip flops F1 and F2. As will be understood by those skilled in the art, the operation of the circuitry is such as to cause to the respective flip flop to complement state each time its clock input is momentarily grounded by closure of the respective set of contacts. The $\overline{Q}$ output of each flip flop is provided as a control signal to external circuitry which is to be controlled by the switch apparatus. The Q output of each flip flop is applied to selectively energize the respective one of the light emitting diodes L1 or L2, these output signals being applied through current limiting resistors R1 and R2 in conventional fashion.

It can thus be seen that, for each closure of the contacts A1, B1 for example, the flip flop F1 will complement state. Thus, upon a first closure of this pair of contacts the light emitting diode L1 will be turned on and upon a second actuation, the light emitting diode will be turned off. At the same time, a signal representing the state of the flip flop F1 is made available to external apparatus which is to be controlled, i.e. through the Q output. The operation of the second set of switch contacts A2, B2 and associated flip flop F2 and light source L2 is essentially identical.

While a particularly simple embodiment has been described by way of illustration, i.e. an embodiment in which the control circuitry has but two states, one energizing the light source and the other de-energizing the light source, it should be understood that more elaborate control circuitry could be implemented in which further states are provided in addition to those two states and that these states may implement additional modes of energization of the light sources, e.g. blinking modes. Likewise, while contact closures have been sensed in this embodiment by simple clocking of flip flop circuits, it should be understood that a more complex system of sensing contact closures may be provided, such as a scanning mode implemented by a state-of-the-art microprocessor circuitry. In any such configuration, the switching apparatus of the present invention fulfills its purpose of providing simple and inexpensive control and indication functions.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

We claim:

1. Touch-responsive indicator switch apparatus comprising:

an electrically energizable light source;

over said light source, three juxtaposed layers at least the uppermost of which is an essentially transparent, flexible material;

on the inward side of the outermost of said layers, a first ring-shaped printed circuit contact element aligned with said source;

on the outer side of the innermost of said layers, a second ring-shaped printed circuit contact element in alignment with the first said contact element, the middle layer being apertured to permit electrical contact between said first and second contact elements when said outer layer is deflected through said aperture; and circuit means interconnected with said light source and said contact elements, said circuit means having a plurality of states including at least a first state in which said source is energized and a second state in which said source is de-energized, said circuit means being responsive to closures between said contact elements for changing states, whereby the state of the circuit means can be altered by deflecting said outermost layer and an indication responsive to the state of the circuit means can be observed through the center portions of said ring-shaped contact elements.

2. Apparatus set forth in claim 1 wherein said light source is a light-emitting diode.

3. Apparatus as set forth in claim 1 further comprising an essentially transparent backing plate interposed between said layers and said light source for supporting the innermost layer against deflection.

4. Apparatus as set forth in claim 3 wherein said light source is a red light emitting diode and said backing plate is formed of a ruby tinted plastic.

5. Apparatus as set forth in claim 3 wherein said innermost layer is apertured through the core of said second ring-shaped contact element.

6. Touch-responsive indicator switch apparatus comprising:

an electrically energizable light source;

over said light source a sheet of an essentially transparent, flexible polymer material folded to provide three juxtaposed layers;

an essentially planar backing means interposed between said source and said folded polymer sheet, said backing means being essentially transparent to the light emitted by said source;

on the underside of the uppermost of said layers, a first ring-shaped printed circuit contact element aligned with said source;

on the upperside of the bottommost of said layers, a second ring-shaped printed circuit contact element in alignment with the first said contact element, the bottommost layer being apertured in the core of said second ring shaped contact element the middle layer being apertured between said ring shaped contact elements to permit electrical contact between said first and second contact elements when said outer layer is touched and deflected through the aperture; and circuit means interconnected with said light source and said contact elements, said circuit means having a plurality of states including at least a first state in which said source is energized and a second state in which said source is de-energized, said circuit means being responsive to closures between said contact elements for changing states, whereby the state of the circuit means can be altered by touching said outermost layer and a visual indication responsive to the state of the circuit means can be observed through the center portions of said ring-shaped contact elements.

7. Apparatus as set forth in claim 6 wherein said source is a light emitting diode.

8. Apparatus as set forth in claim 6 wherein said ring-shaped contact elements are circular.

* * * * *